United States Patent [19]

Coffindaffer et al.

[11] Patent Number: 4,911,853

[45] Date of Patent: Mar. 27, 1990

[54] DRY CLEANING FLUID WITH CURABLE AMINE FUNCTIONAL SILICONE FOR FABRIC WRINKLE REDUCTION

[75] Inventors: Timothy W. Coffindaffer, Loveland; Toan Trinh, Maineville; Leonard Wiliamson, Cincinnati, all of Ohio

[73] Assignee: The Procter & Gamble Company, Cincinnati, Ohio

[21] Appl. No.: 287,781

[22] Filed: Dec. 21, 1988

[51] Int. Cl.[4] ..... C11D 7/50; D06M 13/34

[52] U.S. Cl. ..... 252/8.8; 252/153; 252/170; 252/171; 252/174.15

[58] Field of Search ..... 8/196, 128.3, 142; 252/174.15; 427/393.2

[56] References Cited

U.S. PATENT DOCUMENTS

| | | | |
|---|---|---|---|
| 3,352,790 | 11/1967 | Sugarman et al. | 252/171 |
| 4,246,423 | 1/1981 | Martin | 556/423 |
| 4,477,524 | 10/1984 | Brown et al. | 428/391 |
| 4,639,321 | 1/1987 | Barrat et al. | 252/174.15 |
| 4,665,116 | 5/1987 | Kornhaber et al. | 524/268 |
| 4,708,807 | 11/1987 | Kemerer | 252/8.6 |
| 4,800,026 | 1/1989 | Coffindaffer et al. | 252/8.8 |

FOREIGN PATENT DOCUMENTS

| | | | |
|---|---|---|---|
| 1102511 | 6/1981 | Canada . | |
| 0150867 | 8/1985 | European Pat. Off. | 252/174.15 |

*Primary Examiner*—Prince E. Willis
*Assistant Examiner*—Alexander Ghyka
*Attorney, Agent, or Firm*—Leonard Williamson; Robert B. Aylor; Richard C. Witte

[57] ABSTRACT

This invention relates to dry cleaning fluid compositions comprising curable amine functional silicones for wrinkle reduction and shape retention.

16 Claims, No Drawings

DRY CLEANING FLUID WITH CURABLE AMINE FUNCTIONAL SILICONE FOR FABRIC WRINKLE REDUCTION

FIELD OF THE INVENTION

This invention relates to dry cleaning compositions and to a method for treating fabrics for improved wrinkle reduction.

| U.S. Pat. Documents | | | |
|---|---|---|---|
| Pat. No. | Date | Inventor(s) | U.S. Class/Sub. |
| 2,251,691 | 8/41 | Richardson | 252/162 |
| 3,352,790 | 11/67 | Sugarman et al. | 252/171 |
| 3,549,590 | 12/70 | Holdstock et al. | 260/46.5 |
| 3,576,779 | 4/71 | Holdstock et al. | 260/29.2 |
| 4,246,423 | 1/81 | Martin | 556/423 |
| 4,419,391 | 2/83 | Tanaka et al. | 427/387 |
| 4,477,524 | 10/84 | Brown et al. | 428/391 |
| 4,507,219 | 3/85 | Hughes | 252/118 |
| 4,665,116 | 5/87 | Kornhaber et al. | 524/268 |
| 4,708,807 | 11/87 | Kemerer | 252/8.6 |
| – , now U.S. Pat. No. 4,800,026, issued Jan. 24, 1989 –. | | | |
| Other Documents | | | |
| EPA 0,058,493 | 8/82 | Ona et al. | |
| Can. 1,102,511 | 6/81 | Atkinson et al. | |

BACKGROUND OF THE INVENTION

In the modern world the vast majority of clothing is made from woven fabrics, and the art of weaving is many centuries old. Indeed the invention of weaving is generally attributed to the Ancient Egyptians. Yarns were produced from natural cotton, wool, or linen fibers, and garments made from fabrics woven from these yarns often creased badly in wear and, when washed or dry cleaned, required considerable time and effort with a steam pressing machine or iron to restore them to a pristine appearance.

Dry cleaning is by classical definition a process of cleaning textiles in a nonaqueous liquid medium. Excessive amounts of wet solvents such as water and glycols tend to swell hydrophilic textile fibers causing dimensional changes in yarns, fabrics and garments. Dry solvents such as hydrocarbons and the halocarbons do not swell the textile fibers and they thus have no effect on the physical properties of the textile structure.

Dry cleaning appears to be an old art, with solvent cleaning first being recorded in the British Isles and Scotland in the 1860's. With the large-scale production of gasoline in the United States in the early 1900's, dry cleaning became a growing industry. By the 1930's the less flammable Stoddard solvent replaced gasoline in most dry cleaning operations.

Today, there are thousands of dry cleaning plants in the United States with an estimated annual volume of business in several billion dollars. In the sixties, thousands of self-service type dry cleaning stores were opened across the country.

Dry cleaning systems are closed systems. The systems are closed to prevent loss of cleaning solvent to the environment. Such a system restricts moisture and outside air from the system.

SUMMARY OF THE INVENTION

This invention relates to dry cleaning compositions comprising a curable amine functional silicone (CAFS) agent for fabric wrinkle reduction and shape retention.

It is, therefore, an object of the present invention to provide liquid dry cleaning compositions which provide superior wrinkle reduction benefits to treated garments. It is also an object of the present invention to provide a method for fabric wrinkle reduction and/or form retention by deposition of an effective amount of CAFS onto the fabric in a dry cleaning cycle and preferably followed by steam pressing. These and other objects are obtained herein, and will be seen from the following disclosure.

DETAILED DESCRIPTION OF THE INVENTION

This invention relates to liquid dry cleaning compositions comprising curable amine functional silicone (CAFS) for fabric wrinkle reduction. In another respect this invention relates to methods of using such curable amine functional silicone compositions in the dry cleaning of fabrics for improved wrinkle reduction. Preferred compositions are organic liquids which are added to the dry cleaning fluid. These preferred compositions are organic solvent based liquids, which contain from about 0.1% to about 50%, more preferably from about 0.1% to about 10%, most preferably from about 1% to about 5%, of the curable amine functional silicone. The more concentrated compositions can be diluted in dry cleaning fluid.

The term "wrinkle reduction" as used herein means that a fabric has less wrinkles after a special dry cleaning operation than it would otherwise have after a comparable dry cleaning operation using the basic dry cleaning fluid. This term is distinguished from a waterproofing operation used for fabrics as disclosed in U.S. Pat. No. 4,708,807, Kemerer, issued Nov. 24, 1987.

The term "shape retention" as used herein means that a fabric has less wrinkles and retains its desired shape better after a special dry cleaning operation with CAFS than it would otherwise have after a comparable dry cleaning operation using the basic dry cleaning fluid.

In commonly assigned and copending U.S. patent application Ser. No. 136,586, Coffindaffer and Wong, for a fabric softener composition, filed Dec. 22, 1987, now U.S. Pat. No. 4,800,026, issued Jan. 24, 1989, the present invention is disclosed, and incorporated herein by reference.

It is important to differentiate the curable amine functional silicones and the noncurable amine functional silicones. The curable amine functional silicone molecules have the ability to react one with the other to yield a polymeric elastomer of a much higher molecular weight compared to the original molecule. Thus, "curing" often occurs when two CAFS molecules or polymers react, yielding a polymer of a higher molecular weight. [$\sim SiOH + \sim SiOH \rightarrow \sim SiOSi \sim + H_2O$]. A more detailed version of the curing reaction is given below. This "cure" is defined herein as the formation of silicon-oxygen-silicon linkages. The silicon-oxygensilicon linkage cure is distinguished from polysiloxane bridging reactions between amino groups and carboxyl (or epoxy) groups as disclosed in EPA No. 058,493, Ona et al., published Aug. 25, 1982, (Bulletin 82/34).

Curable amine functional silicones are commercially available; e.g., Dow Corning Silicone 531 and Silicone 536, General Electric SF 1706, SWS Silicones Corp. SWS E-210 are commercially available curable amine functional silicones widely marketed for use in hard surface care, such as in auto polishes, where detergent resistance and increased protection are very important.

Unlike curable silicones, noncurable silicones do not have the ability to react with one another and thus maintain a near constant molecular weight. Canadian Pat. No. 1,102,511, Atkinson et al., issued June 9, 1981, incorporated herein by reference, discloses noncurable amine functional silicones in liquid fabric softener compositions for fabric feel benefits. It is important to note, however, that Atkinson et al. does not teach curable amine functional silicones (CAFS). Surprisingly the curable amine functional silicones plus a suitable carrier to deposit an effective amount of the CAFS on fabric are excellent for fabric wrinkle reduction. Accordingly, several fabric care compositions containing curable amine functional silicones are herein disclosed. Several methods of using curable amine functional silicones for wrinkle reduction fabric care are also disclosed.

The CAFS compositions of this invention are used with a suitable liquid dry cleaning fluid or solvent carrier. The term "carrier" as used herein in general means any suitable vehicle that is used to deliver the CAFS and deposit it on the fabric. This invention comprises a liquid dry cleaning fluid composition comprising the CAFS plus dry cleaning solvent, which is a suitable carrier.

The present invention includes a CAFS/organic solvent based concentrate which is added to dry cleaning fluid.

Suitable commercially available dry cleaning fluids are based on petroleum hydrocarbons, chlorinated hydrocarbons and aromatic hydrocarbons. The new dry cleaning fluid/CAFS product of this invention provides an unexpected wrinkle reduction benefit. In the wash, the level of CAFS should be about from about 0.5–1,000 ppm, preferably from about 1∝300 ppm, and more preferably from about 5–15 ppm.

CAFS concentrates or additives can be from about 1% to about 50% CAFS in any suitable organic solvent base.

Preferably, care should be taken to insure that the compositions of the present invention are essentially free of trace moisture, heavy waxes, abrasives, fiberglass, and other fabric incompatibles.

Curable Amine Functional Silicone (CAFS)

Curable amine functional silicones can be prepared by known methods. U.S. Pat. Nos. 3,549,590, issued Dec. 22, 1970, and 3,576,779, issued Apr. 27, 1971, both to Holdstock et al., and assigned to General Electric Co., and incorporated herein by reference; U.S. Pat. Nos. 3,355,424, Brown, issued Nov. 28, 1967, and 3,844,992, Antonen, issued Oct. 29, 1974, both incorporated herein by reference, disclose methods of making curable amine functional silicones. Useful amino functional dialkylpolysiloxanes and methods for preparing them are described in U.S. Pat. Nos. 3,980,269, 3,960,575 and 4,247,330, whose pertinent disclosures are incorporated herein by reference. Curable amine functional silicones are disclosed in U.S. Pat. No. 4,419,391, Tanaka et al., issued Dec. 6, 1983, incorporated herein by reference.

The curable amine functional silicones of the present invention are preferably essentially free of silicone polyether copolymers disclosed in U.S. Pat. No. 4,246,423, Martin, issued Jan. 20, 1981.

The terms "amine functional silicone" and "aminoalkylsiloxane" are synonymous and are used interchangeably in the literature. The term "amine" as used herein means any suitable amine, and particularly cycloamine, polyamine and alkylamine, which include the curable alkylmonoamine, alkyldiamine and alkyltriamine functional silicones. The term "silicone" as used herein means a curable amine functional silicone, unless otherwise specified.

The preferred CAFS used in the present invention has an initial (before curing) average molecular weight of from at least about 1,000 up to about 100,000, preferably from about 1,000 to about 15,000, and more preferably from about 1,500 to about 5,000. While not being bound to any theory, it is theorized that the lower molecular weight CAFS compounds of this invention are best because they can penetrate more easily into the yarns of the fabric. The lower molecular weight CAFS is preferred, notwithstanding its expense and difficulty in preparation and/or stabilization.

The preferred CAFS of this invention when air dried cures to a higher molecular weight (MW) polymer. The CAFS of this invention can be either branched or straight chained, or mixtures thereof.

The preferred CAFS of this invention has the following formula:

$$((RO)R'_2\,SiO_{\frac{1}{2}})X\,(R'_2SiO_{2/2})Y\,(R''SiO_{3/2})Z;$$

wherein

X is equal to Z+2;

Y is at least 3, preferably 10 to 35, and is equal to or greater than 3Z;

for a linear CAFS Z is zero;

for a branched CAFS Z is at least one;

R is a hydrogen or a $C_{1-20}$ alkyl; and

R', R'' is a $C_{1-20}$ alkyl or an amine group; wherein at least one of R' or R'' is an amine group.

In the more preferred CAFS, R is a hydrogen or a $C_{1-3}$ alkyl;

R' is $C_{1-3}$ alkyl; and R'' is an alkylamine group having from about 2 to about 7 carbon atoms in its alkyl chain.

The value of Y and Z are dictated by the molecular weight of the CAFS. The value of Y is preferably 10 to 35 and the value of Z is preferably 1 to 3.

In the nomenclature "$SiO_{178}$" means the ratio of oxygen atoms to silicone atoms, i.e., $SiO_{178}$ means one oxygen atom is shared between two silicone atoms. Preferred curable amine functional silicone agents are in the form of aqueous emulsions containing from about 10% to about 50% CAFS and from about 3% to about 15% of a suitable emulsifier.

General Electric Company's SF 1706 neat silicone (CAFS) fluid is a curable polymer that contains amine functional and dimethyl polysiloxane units.

Typical product data for SF 1706 silicone fluid is:

| Property | Value |
|---|---|
| CAFS content | 100% |
| Viscosity, cstks 25° C. | 15–40 |
| Specific gravity at 25° C. | 0.986 |
| Flash point, closed cup °C. | 66 |
| Amine equivalent (milli-equivalents of base/gm) | 0.5 |
| Diluents | Soluble in most aromatic and chlorinated hydrocarbons |

SF 1706 can be diluted to a concentration of from about 0.1% to about 80% and carried to fabrics via a suitable dry cleaning fluid.

A particularly preferred CAFS has the following formula:

$$((RO)R'_2SiO_{1/2})X\ (R'_2SiO_{2/2})Y\ (R''SiO_{3/2})Z$$

wherein R is methyl; R′ is methyl; and R″ is $(CH_2)_3NH(CH_2)_2NH_2$ X is about 3.5; Y is about 27; and Z is about 1.5. The average molecular weight of such a curable amine functional silicone is about 2,500, but can range from about 1,800 to about 2,800. Other useful CAFS materials are disclosed in U.S. Pat. Nos. 4,665,116, Kornhaber et al., issued May 12, 1987 and 4,477,524, Brown et al., issued Oct. 16, 1984.

The curing of the CAFS requires moisture ($H_2$). This moisture can be provided by steam or moist air.

In use it is believed that hydrolysis and curing of the CAFS are as follow:

Hydrolysis Step

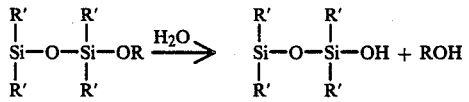

Curing Step

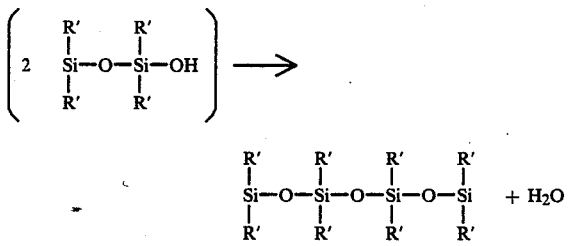

The fabric care composition of this invention comprises a suitable curable amine functional silicone and an organic dry cleaning solvent.

A preferred commercially available CAFS is sold by the General Electric Company under the trade name SF 1706.

Dry Cleaning Fluid

The present invention is a dry cleaning fluid composition comprising an effective amount of CAFS and up to about 99% dry cleaning fluid composition selected from conventional dry cleaning solvents. Dry cleaning solvents are employed to aid in soil removal and to act as a carrier for the curable amine functional silicone and other nonvolatile components. Thus, any of the solvents used in the dry cleaning art may be used herein. Examples of such solvents include petroleum hydrocarbons, e.g., mineral spirits, and Stoddard solvent; chlorinated hydrocarbons, e.g., trichloroethylene and perchloroethylene; and aromatics, e.g., xylene and toluene, and mixtures thereof.

The amount of solvent included in the dry cleaning fluid compositions of the present invention can vary depending upon the solvent used and the type of composition to be formulated. The dry cleaning fluid of the present invention can be used as a primary or as a secondary cleaning fluid. In the secondary cleaning fluid, more of the curable amine functional silicone can be used to insure greater deposition.

In recent years, perchloroethylene has replaced much of the petroleum based solvent. The main advantage of the chlorinated hydrocarbon solvents is, of course, their nonflammability. Carbon tetrachloride is less preferred and due to its toxicity and corrosive properties it has now been largely replaced by perchloroethylene. Trichloroethylene, less toxic and more stable than carbon tetrachloride, is a preferred dry cleaning solvent.

Trichlorotrifluoroethane and other fluorinated hydrocarbon solvents are also suitable solvents. In general, many of the fluorinated compounds are more stable and less toxic than perchloroethylene. Solvent blends and azeotropic mixtures used in dry cleaning can be used.

Along with the development of improved, stabilized solvents, and other additives, many improvements in the equipment for more efficient dry cleaning operations is in the literature. See "Dry Cleaning & Degreasing Chemicals and Processes," Keith Johnson, Noyes Data Corp., Park Ridge, NJ, 1973.

Optional Components

Optional components for use in the dry cleaning fluids herein include those described in U.S. Pat. Nos. 3,642,644, Grote et al., issued Feb. 15, 1972, and 3,630,935, Potter, Jr., issued Dec. 28, 1971, both incorporated herein by reference. Such optional components generally represent less than about 15%, preferably from about 2% to about 10%, by weight of the composition.

EXAMPLE I

About 0.1 part of GE SF-1706 is added to 99 parts of perchloroethylene with stirring at ambient temperature. This mixture containing about 0.1% or about 100 ppm CAFS is used to dry clean a small bundle of fabrics with agitation.

The dry cleaned fabrics are steam pressed to cure CAFS for improved wrinkle reduction and shape retention.

EXAMPLES II–V

Same as Example I, except that 0.01, 0.5, 1 and 2 parts/99 parts, respectively, of perchloroethylene are used.

What is claimed is:

1. A dry cleaning fluid composition comprising: (1) a wrinkle reducing level of a suitable curable amine functional silicone agent for wrinkle reduction, and (2) an effective amount of a dry cleaning solvent carrier to deposit an effective amount of said curable amine functional silicone on said fabric, and wherein said curable amine functional silicone on said fabric cures to form silicon-oxygen-silicon linkages.

2. The composition of claim 1 wherein said solvent carrier is selected from the group consisting of: petroleum hydrocarbons, chlorinated hydrocarbons, aromatic hydrocarbons, and mixtures thereof.

3. The dry cleaning fluid composition of claim 1 wherein said curable amine functional silicone agent is present at a level of from about 0.5 ppm to about 1,000 ppm.

4. The dry cleaning fluid composition of claim 3 wherein said dry cleaning fluid contains from about 1 ppm to about 300 ppm of said curable amine functional silicone and said dry cleaning solvent is a chlorinated hydrocarbon.

5. The dry cleaning fluid composition of claim 4 wherein said concentrate contains from about 5 ppm to about 150 ppm of said curable amine functional silicone.

6. The dry cleaning fluid composition of claim 4 wherein said curable amine functional silicone has an average molecular weight of from about 1,000 to about 100,000.

7. The dry cleaning fluid composition of claim 6 wherein said silicone has an average molecular weight of from about 1,000 to about 15,000.

8. The dry cleaning fluid composition of claim 7 wherein said silicone has an average molecular weight of from about 1,500 to about 5,000.

9. The dry cleaning fluid composition of claim 1 wherein said curable amine functional silicone is selected from the group of linear and branch curable amine functional branch silicones and mixtures thereof having the following structure:

$$((RO)R'_2\,SiO_{\frac{1}{2}})X\,(R'_2\,SiO_{2/2})Y\,(R''SiO_{3/2})Z;$$

wherein

X is equal to Z+2; and

Y is at least 3; and wherein

Z is zero for a linear curable amine functional silicone;

Z is at least one for a branched curable amine functional silicone;

wherein

R is a hydrogen or a $C_{1-20}$ alkyl; and

R', R'' is a $C_{1-20}$ alkyl or an amine group selected from cyclic amines, polyamines and alkylamines having from about 2 to about 7 carbon atoms in their alkyl chain, and wherein at least R' or R'' is an amine group.

10. The dry cleaning fluid composition of claim 9 wherein

R is a hydrogen or a $C_{1-3}$ alkyl;

R is $C_{1-3}$ alkyl; and

R'' is an alkylamine group having from about 2 to about 7 carbon atoms in its alkyl chain.

11. The dry cleaning fluid composition of claim 10 wherein said R is methyl; R' is methyl and R'' is $(CH_2)_3NH(CH_2)_2NH_2$; and X is about 3.5; Y is about 27 and Z is about 1.5; and wherein said curable amine functional silicone has a molecular weight in the range of from about 1,000 to about 2,800 and a viscosity of about 5–40 centistokes at 25° C.

12. A method of reducing wrinkles in dry cleaned fabrics comprising dry cleaning said fabrics in an effective amounts of dry cleaning solvent and a curable amine functional silicone.

13. The method of claim 12 wherein said curable amine functional silicone is present in said dry cleaning fluid at a level of from about 1 ppm to about 300 ppm.

14. The method of claim 12 wherein said curable amine functional silicone is present in said dry cleaning fluid at a level of from about 5 ppm to about 150 ppm.

15. A dry cleaning fluid additive comprising a curable amine functional silicone agent for wrinkle reduction wherein said additive is added to a dry cleaning solvent carrier selected from the group consisting of: petroleum hydrocarbons, chlorinated hydrocarbons, aromatic hydrocarbons, and mixtures thereof, to provide from about 1 ppm to about 300 ppm of said curable amine functional silicone.

16. The additive of claim 15 wherein said curable amine functional silicone is dispersed in an organic solvent base at a level of from about 0.1% to about 50%.

* * * * *

UNITED STATES PATENT AND TRADEMARK OFFICE

CERTIFICATE OF CORRECTION

PATENT NO. : 4,911,853

DATED : March 27, 1990

INVENTOR(S) : Timothy W. Coffindaffer, Toan Trinh and Leonard Williamson

It is certified that error appears in the above-identified patent and that said Letters Patent is hereby corrected as shown below:

Col. 2, lines 57-58, "silicon-oxygensilicon" should read -- silicon-oxygen-silicon --.

Col. 3, line 9, "Surprisingly" should begin a new paragraph.

Col. 3, line 34, "1 α 300" should read -- 1-300 --.

Col. 3, line 35, "5-15" should read -- 5-150 --.

Col. 4, line 42, " "$SiO_{178}$" " should read -- "$SiO_{1/2}$" --.

Col. 4, line 43, "$SiO_{178}$" should read -- $SiO_{1/2}$ --.

Col. 4, line 45, "Preferred" should begin a new paragraph.

Col. 5, lines 16-33, the following formula:

" <u>Hydrolysis Step</u>

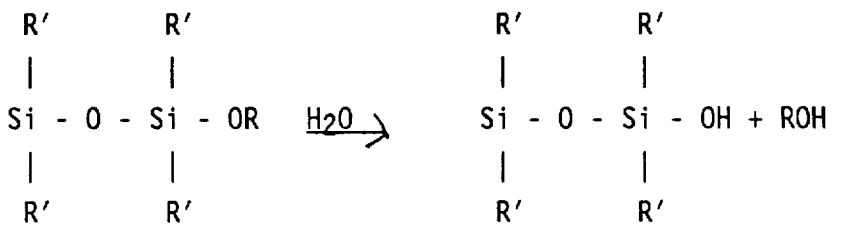

<u>Curing Step</u>

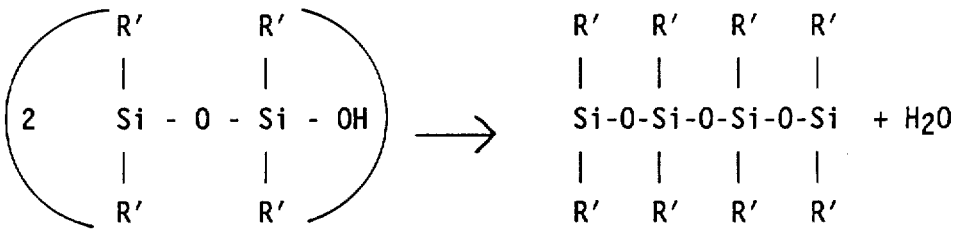

"

UNITED STATES PATENT AND TRADEMARK OFFICE

CERTIFICATE OF CORRECTION

PATENT NO. : 4,911,853

DATED : March 27, 1990

INVENTOR(S) : Timothy W. Coffindaffer, Toan Trinh and Leonard Williamson

It is certified that error appears in the above-identified patent and that said Letters Patent is hereby corrected as shown below:

should read --

Hydrolysis Step

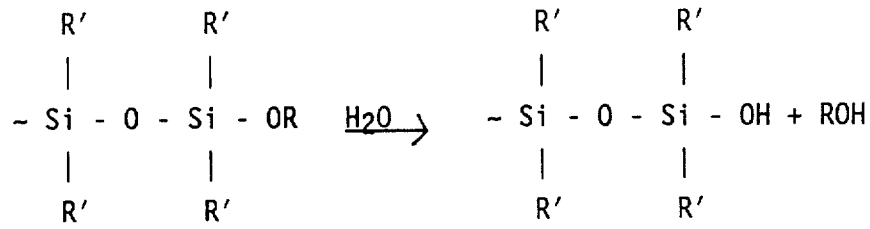

Curing Step

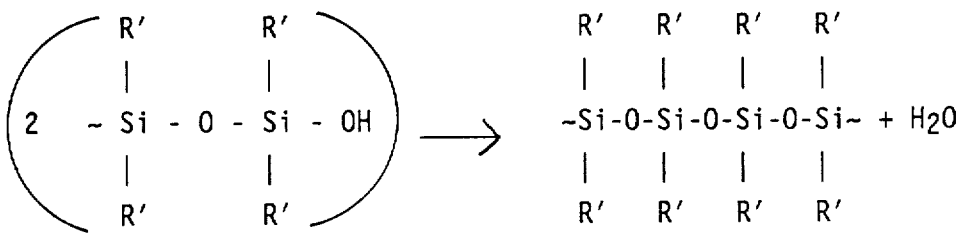

--.

Signed and Sealed this

Seventeenth Day of December, 1991

*Attest:*

*Attesting Officer*

HARRY F. MANBECK, JR.

*Commissioner of Patents and Trademarks*